United States Patent [19]

Cammack, II et al.

[11] 4,100,089

[45] Jul. 11, 1978

[54] HIGH-VOLTAGE INSULATING MATERIAL COMPRISING ANTI-TRACKING AND EROSION INHIBITING COMPOUNDS WITH INSULATING POLYMERS

[75] Inventors: Travers Kregg Cammack, II, Union City; David Dolph Nyberg, Sunnyvale, both of Calif.

[73] Assignee: Raychem Corporation, Menlo Park, Calif.

[21] Appl. No.: 649,797

[22] Filed: Jan. 16, 1976

[51] Int. Cl.[2] ..... H01B 3/00

[52] U.S. Cl. ..... 252/63; 174/137 B; 174/138 C; 252/63.7; 252/63.5; 260/45.7 PS; 260/45.7 P; 260/45.7 PH

[58] Field of Search ..... 200/144 R, 151; 174/137 B, 138 C; 252/63, 63.7, 63.5; 260/45.7 R, 45.7 PS, 45.7 PH

[56] References Cited

U.S. PATENT DOCUMENTS

| | | | |
|---|---|---|---|
| 2,768,264 | 10/1956 | Jones et al. | 200/151 |
| 2,997,526 | 8/1961 | Kessel et al. | 174/137 B |
| 2,997,527 | 8/1961 | Kessel et al. | 174/137 B |
| 2,997,528 | 8/1961 | Kessel et al. | 174/137 B |
| 3,035,209 | 5/1962 | Smith | 174/137 B |
| 3,192,347 | 6/1965 | Stringfellow et al. | 174/138 C |
| 3,280,070 | 10/1966 | Battista et al. | 260/45.7 PS |
| 3,285,954 | 11/1966 | Uhing | 260/45.7 PS |
| 3,325,444 | 6/1967 | Best et al. | 260/45.7 PS |
| 3,339,013 | 8/1967 | Gainer et al. | 174/137 B |
| 3,475,546 | 10/1969 | Sadler | 174/137 B |
| 3,586,802 | 6/1971 | Nichols et al. | 200/151 |
| 3,626,083 | 12/1971 | Minter et al. | 174/137 B |
| 3,645,899 | 2/1972 | Linson | 174/137 B |
| 3,649,542 | 3/1972 | Hasebe et al. | 252/63.7 |
| 3,676,393 | 7/1972 | Piirma | 260/45.7 PS |
| 3,875,264 | 1/1975 | Hofer et al. | 260/45.7 PS |
| 3,898,372 | 8/1975 | Kalb | 174/137 B |
| 3,935,157 | 1/1976 | Schiller et al. | 174/137 B |

OTHER PUBLICATIONS

Condensed Chemical Dictionary, 8th Edition, Van Nostrand Reinhold Co., c 1971, p. 687.

*Primary Examiner*—Ralph S. Kendall
*Assistant Examiner*—John D. Smith
*Attorney, Agent, or Firm*—Lyon & Lyon

[57] ABSTRACT

An improved high voltage insulating material comprising one or more polymers and an anti-tracking and erosion inhibiting composition comprising a hydrate of alumina and one or more compounds selected from the groups consisting of nickel phosphate, phosphinic acid or a derivative thereof, phosphonous acid or a derivative thereof, and phosphonic acid or a derivative thereof. The composition functions to prevent failure by tracking and to substantially retard failure by erosion.

36 Claims, No Drawings

HIGH-VOLTAGE INSULATING MATERIAL COMPRISING ANTI-TRACKING AND EROSION INHIBITING COMPOUNDS WITH INSULATING POLYMERS

FIELD OF THE INVENTION

The present invention relates to an improved high-voltage insulating material and, in particular, relates to an improved high voltage insulating material comprising one or more polymers and an improved anti-tracking and erosion inhibitor composition.

BACKGROUND OF THE INVENTION

While polymeric materials are used for insulating a wide variety of electrical apparatus, they pose serious problems for high voltage applications in contaminated atmospheres where moisture or fog, together with salts, dust particles and ionic pollution, causes leakage currents to flow across the surface of the insulation. This current causes a rise in temperature with consequent moisture evaporation and ultimately dry band information. The electrical stress across these dry bands often exceeds the breakdown stress of the air-insulation interface, so that discharge or spark scintillation takes place. The spark temperature is extremely high, often 2000° C or higher, and the heat produced thereby may be sufficient to cause degradation of the insulation surface with the ultimate formation of carbonaceous spots. These carbonaceous spots usually link up in dendritic fashion and the organic insulation fails by progressive creepage tracking.

Over the years, many solutions to this problem have been proposed. Perhaps the most effective has been the incorporation of hydrated alumina, preferably the trihydrate, in fairly substantial quantities into, for example, butyl rubber, epoxy resins, especially of the cycloaliphatic type, and, more recently, into ethylene-propylene rubbers as taught, for example, in U.S. Pat. Nos. 2,997,526; 2,997,527; and 2,997,528, the disclosures of which are incorporated herein by reference. It was found in practice that the polymeric materials containing large proportions of alumina trihydrate were substantially protected against tracking. However, in some cases, the materials still failed by tracking and further, in many cases, the materials failed by a gradual and progressive in-depth erosion or cratering of the insulation which occurs during over-voltage exposure. Further, the amount of alumina hydrate required to produce the anti-tracking effect is very high and is usually in the region of 50–90% by weight of the entire insulation. In the case of polymers that are shaped by molding or extrusion or used to make heat-recoverable articles, a content of alumina hydrate this high is undesirable because the high temperature used and/or the radiation employed in cross-linking causes loss of the hydrated water with accompanying development of porosity and the formation of voids leading ultimately to failure of the insulation. The high filler content is also undesirable because it is detrimental to certain mechanical properties of the polymer such as elongation.

Another solution to the tracking and erosion problem is disclosed in a copending commonly assigned application of Penneck et al, Ser. No. 434,126, filed Jan. 17, 1974. Penneck discloses forming an anti-tracking filler composition comprising a mixture of alumina hydrate and the oxides of transition elements, elements of the lanthanide series or of the non-transuranic actinide series. The composition is effective in preventing tracking and also functions to retard erosion. However, the oxides, such as iron oxide, are often highly colored which, in some cases, precludes their use due to environmental and/or aesthetic considerations. It has, therefore, been found that it would be desirable to form an anti-tracking and anti-erosion composition that would be even more effective in retarding the erosion rate of the polymer and that would also be a neutral color to allow coloring of the polymer with light gray or blue pigments.

SUMMARY OF THE INVENTION

Accordingly, one object of this invention is to provide an improved material for use as high voltage insulation. Another object of this invention is to provide a material for high voltage insulation having a neutral color. Yet another object of the present invention is to provide an anti-tracking and erosion inhibiting composition which prevents failure of polymer insulation by tracking and substantially retards failure by erosion.

These and other objects and advantages are obtained by forming an electrically insulating material comprising one or more polymers and an anti-tracking and erosion inhibiting composition comprising an anti-tracking additive and a compound selected from nickel phosphate, phosphinic acid and its derivatives, phosphonous acid and its derivatives, phosphonic acid and its derivatives and mixtures thereof. The composition functions to prevent failure by tracking and to substantially retard failure by erosion. Further, the composition is neutrally colored to enable compliance with environmental and aesthetic considerations.

DETAILED DESCRIPTION OF THE INVENTION

The present invention contemplates the formation of an electrically insulating material comprising one or more polymers and an anti-tracking and erosion inhibiting composition comprising (a) an anti-tracking additive and (b) a member selected from the group consisting of nickel phosphate, phosphinic acid and its derivatives, hypophosphorous acid and its derivatives (which are named as if the parent acid was named phosphinic acid), orthophosphorous acid and its derivatives (which are named as if the parent acid was named phosphonic acid), and mixtures thereof.

Anti-tracking additives presently known to the art include alumina, hydrates of alumina, magnesia and hydrates of magnesia. Alumina hydrates are preferred, the trihydrate, $Al_2O_3.3H_2O$ being particularly preferred. The anti-tracking additive preferably constitutes a major portion of the anti-tracking and erosion inhibiting system.

The use of alumina hydrate or other anti-tracking additive of high surface area will significantly enhance the properties of the insulating materials of the present invention. By high surface area we mean an area of at least $1m^2/g$. The surface area is suitably measured by the Brunauer, Emmett and Teller (BET) nitrogen adsorption method which assumes that the area covered by a nitrogen molecule is $16.2Å^2$. (The BET method is referred to, for example, in "The Physics and Chemistry of Surfaces" by N. K. Adam, published by Dover, and in "Solid Surfaces and the Gas-Solid Interface", Advances in Chemistry Series Volume 33.) It is particularly preferred that the specific surface area of alumina hydrate when used in the present invention be at least about $4m^2/g$ and advantageously be somewhat greater than $6m^2/g$. Especially good results are obtained when the specific area is equal to or geater than $8m^2/g$. Use of alumina hydrate with a lower surface area will, however, still yield advantageous results. Although alumina hydrate of varying particle sizes may be employed, preferably it has a maximum particle size less than about 2 microns and, more preferably, less than about 1.6 microns.

The specific surface areas and particle size distributions of two forms of alumina trihydrate presently regarded as particularly suited for use in the present invention are given below.

| | A | B |
|---|---|---|
| Weight % less than 2 microns | 100 | 100 |
| Weight % less than 1 micron | 99.5 | 80 |
| Weight % less than 0.5 micron | 60 | 21 |
| Specific surface area $m^2/g$ (approximate) | 12–15 | 6–8 |

Types A and B are sold by the Aluminum Company of America (Alcoa) as "Hydral 705" and "Hydral 710", respectively. It is to be noted that the above surface areas are those reported by Alcoa. However, the actual surface area may vary from that reported. For example, actual surface areas for samples of A generally vary from about 6 to $21m^2/g$, averaging about $12m^2/g$.

Hydral 705 gives generally good results when used in the anti-tracking systems of the present invention, especially when the surface area is $10m^2/g$ or higher.

Alumina hydrate of the desired specific surface area may be prepared by well known methods; for example, by dissolving alumina in caustic soda and then reprecipitating it by bubbling carbon dioxide through the solution. Using this procedure, alumina hydrate of the desired specific surface area can be obtained by adjusting the pH of the solution and the rate at which carbon dioxide is bubbled into the solution. The optimum values that will produce the desired surface area can readily be determined by routine experimentation.

Among the compounds suited for use as component (b) are hypophosphorous acid and its derivatives having the general formula I, phosphonous acid and its derivatives having the general formula II, and phosphonic acid and its derivatives having the general formula III wherein, in either formula, X can be oxygen or sulfur.

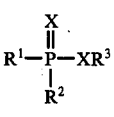
FORMULA I

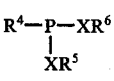
FORMULA II

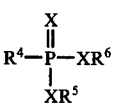
FORMULA III $R^1$ through $R^6$ can be the same or different and are preferably selected from hydrogen or an organo group bound to P or X by carbon. Suitable organo groups include, but are not limited to, substituted and unsubstituted alkyl groups, substituted and unsubstituted aryl groups, substituted and unsubstituted heterocyclic groups and substituted and unsubstituted heteroaryl groups. The alkyl groups can be linear, branched or cyclic groups and can also be saturated or unsaturated.

Suitable heteroatoms for the heterocyclic and heteroaryl groups include nitrogen, oxygen, silicon, sulfur and boron.

Suitable substituents for the organic groups include halogen, particularly chlorine and bromine, $-NO_2$, $-CN$, $-NR_2$, $-OR$, $-SR$,

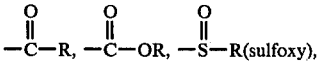

and $-SO_2R$ (sulfonyl) wherein R may be hydrogen or an organo group of the same type as $R^1$ through $R^6$. Other suitable substitutes include alkyl, aryl, heterocyclic and heteroaryl groups as described above. Also, one of the groups $R^1$ to $R^6$ may be linked to another to form a cyclic phosphinate, phosphonite, or phosphonate. $R^3$, $R^5$, and $R^6$ can also be a metallic or a substituted or unsubstituted ammonium cation to form salts of the compounds of Formula I and Formula II.

Examples of suitable alkyl groups are methyl, ethyl, propyl, butyl, pentyl, hexyl, heptyl, octyl, nonyl, decyl, tetradecyl, octadecyl, ethenyl, propenyl, butenyl, hexenyl, octenyl, decenyl, propynyl, butynyl, pentynl, octynyl, decynyl, cyclopropyl, cyclobutyl, cyclopentyl, cyclohexyl, cyclooctyl and cyclodecyl and branched and substituted derivatives of the above.

Examples of suitable aryl groups are phenyl, naphthyl, and anthracyl including substituted derivatives thereof.

Examples of suitable heterocyclic groups are tetrahydrofuryl, dihydrofuryl, tetrahydrothienyl, morpholinyl, piperidyl pyrolidinyl, 1,4-dioxanyl and the like, including substituted derivatives thereof.

Examples of suitable heteroaryl groups are pyrrolyl, furyl, thienyl, picolinyl, imidazolyl, purinyl, pyridyl and the like, including substituted derivatives thereof.

Preferred organo groups are unsubstituted and substituted alkyl groups and unsubstituted and substituted aryl groups. Among substituted alkyl groups may be mentioned 2-hydroxymethyl, 2-chloroethyl, 2-ethoxyethyl, 2-acetylethyl, 2-acetoxyethyl, 2-formylethyl, 3-hydroxypropyl, 2-chloropropyl, 4-hydroxypentyl, 3-phenylpentyl, benzyl, 2-ethoxypropyl, 2-aminoethyl, 3-aminopropyl, 9-aminononyl, aminomethyl, and the like.

Among substituted aryl groups may be mentioned nitrophenyl, chlorophenyl, 1,3-dichlorophenyl, cyanophenyl, methoxyphenyl, ethoxyphenyl, tolyl, 1,3 dimethylphenyl, phenoxyphenyl, hydroxyphenyl, aminophenyl, acetylphenyl, 2-methylnaphthyl, 1-nitronaphthyl, 1-choloronaphthyl, n-butylphenyl, t-butylphenyl, 1,3-di-t-butylphenyl and the like.

Organo groups, particularly preferred at the present, include linear and branched alkyl groups having 1–10 carbon atoms, the benzyl group and hydroxybenzene groups, particularly those substituted with one or more alkyl groups of 1–10 carbon atoms.

Suitable cations for forming salts are alkali metals, alkaline earth metals, quaternary ammonium ions and transition elements in subgroups IVa, Va, VIa, VIIa, and Group VII of Mendeleef periodic table which are not in the nontransuranic actinide series, e.g., titanium, zirconium and hafnium; vanadium, niobium, and tantalum; chromium; molybdenum and tungsten; manganese, technetium, and rhenium; and iron, cobalt, nickel, ruthenium, rhodium, palladium, osmium, iridium and platinum.

It has also been found that nickel phosphate is suitable as component (b). Furthermore, mixtures of two or more compounds may also be employed for component (b).

The above examples are given merely by way of illustration and not of limitation and it will be obvious to one skilled in the art that other suitable derivatives of phosphonic, phosphonous, and phosphinic acid may also be utilized in the practice of this invention.

While we do not wish to be limited by any particular theoretical or mechanistic interpretation, component (b) is believed to interact synergistically with the anti-tracking additive to substantially retard erosion, and may be used in quantities as low as 0.25% by weight based on the total weight of the insulation material or in some instances as low as 0.1%. In general, however, it is preferably present in an amount in the range of from about 0.35 to 1.50% by weight. In many instances, amounts higher than 1.50% may be advantageously employed, for example as much as 5% by weight or even greater amounts, particularly when very high voltage stresses are anticipated.

In some cases, component (b) is a liquid or a solid having a low melting point, thereby enabling complete admixing of the component with the polymer during processing. In other cases, component (b) is soluble in the polymer. However, in the cases where component (b) has a high melting point and is not soluble in the polymer, it is preferred that component (b) have a particle size less than about 75 microns and, more preferably, that it have a particle size less than 45 microns. It may then be substantially homogeneously incorporated by milling, Banbury mixing or by other known polymer blending techniques.

Certain of the compounds suited as component (b) also provide a further advantage in that they also function in combination with other additives to provide protection from ultraviolet radiation. In the case of polymeric insulating materials for outdoor use, an exposure lifetime running into decades, typically 10–30 years, is required. Many polymeric insulating materials are not sufficiently stable to ultraviolet(U.V.)radiation without additives to endure this length of time. Therefore, it is necessary to incorporate into the polymer additives which function as U.V. stabilizers or screens. Alumina hydrate alone does not provide sufficient protection from U.V. radiation. One material which is utilized in small quantities as a U.V. screen is carbon black. Unfortunately, with prior art formulations, carbon black, even in small concentrations of the order of 0.3% or less, causes rapid failure of the insulation by tracking. Other organic U.V. screens such as, for example, substituted benzophenones or benzotriazoles have been utilized. However, unfortunately, these are significantly less effective than carbon black or the combination of component (b) with thoe additives.

Since it has been the experience of the prior art that carbon black accelerates failure by tracking, another surprising advantage of the present invention is that carbon black can be incorporated into the insulation as a U.V. screen without causing failure by progressive tracking. This is particularly advantageous when component (b) itself is not suited as a U.V. screen. Further, small quantities of carbon black may advantageously be incorporated into the insulation as a coloring agent. The resultant insulation has an aesthetically pleasing and environmentally compatible gray color.

It will be appreciated by those skilled in the art that the amount of the anti-tracking and erosion inhibiting composition used which will demonstrate a beneficial effect can vary over a wide range depending inter alia upon the voltage stress to which the material is subjected. In general, the anti-tracking and erosion inhibiting composition will constitute from about 20% to about 75% of the total weight of the insulating material. However, owing to the synergistic effect between component (b) and the alumina hydrate, it is possible to reduce the proportion of the composition even to 15% in some cases without significant loss of anti-tracking and erosion inhibiting properties. This is especially useful in the formation of heat-recoverable articles from the insulating materials of this invention. It may be necessary to use from 15 to 45% to minimize the development of porosity during manufacture and to retain the degree of elongation, modulus and tensile strength above the crystalline melting point of the polymer used in the insulation required for some purposes. If the material is to be used in other than heat-recoverable applications, then the proportion of the anti-tracking and anti-erosion composition in the insulating material may be increased to even greater than 40%, for example 60% or higher since this lessens the overall cost of the insulation. Therefore, the preferred proportion of anti-tracking and erosion inhibiting composition in general falls within the range of from 20 to 60% of the total weight of the insulation.

In general, virtually any polymer normally used for high voltage insulation may suitably be used in this invention. Among polymeric materials into which the anti-tracking and erosion composition of the present invention may be suitably incorporated there may be mentioned polyolefins and other olefin polymers, obtained from two or more olefinic comonomers, especially olefin terpolymers, polyacrylates, silicone polymers and epoxides, especially cycloaliphatic epoxides. Among epoxide resins of the cycloaliphatic type there may especially be mentioned those sold commercially by CIBA (A.R.L.) limited under the names CY 185 and CY 183. Particularly suitable polymers include polyethylene, ethylene/ethyl acrylate copolymers, ethylene/-vinyl acetate copolymers, ethylene/propylene copolymers, ethylene/propylene non-conjugated-diene terpolymers, polypropylene, polydimethyl siloxane, dimethyl siloxane/methyl vinyl siloxane copolymers, fluoro silicones, e.g., those derived from 3,3-trifluoropropyl siloxane, carborane siloxanes, e.g., "Dexsil" polymers made by Olin Mathieson, polybutyl acrylate butyl/ethyl acrylate copolymers, butyl acrylate/glycidyl methacrylate copolymers, polybutene, butyl rubbers, ionomeric polymers, e.g., "Surlyn" materials sold by DuPont, or mixtures of any two or more of the above. For applications, requiring heat-recoverable articles, preferably the polymer is selected from cross-linked crystalline members of the polymer group. The manner in which polymers are rendered heat-recoverable is set forth in, for example, Cook, U.S. Pat. No. 3,086,242, the disclosure of which is incorporated by reference.

Among the many uses for the insulating materials of the present invention there may especially be mentioned the fabrication of heat-shrinkable tubing, heat-shrinkable 3-core cable termination breakouts and insulators for use at high voltages of up to 35 KV and even much higher. These and other shaped parts are especially useful in the termination of high voltage cables to overhead lines, to transformers and to switch-gear, especially in outdoor environments.

The insulating material of the present invention may also, in some cases, advantageously be applied to a termination or other element in situ, for example, by application of the basic composition in the form of a lacquer in a suitable solvent; for example, toluene, xylene or carbon tetrachloride. In some cases, especially when the polymer component is a silicone, the composition may itself be sufficiently fluid for in situ application following which it will harden on standing.

it will be appreciated that even though the primary purpose of the anti-tracking and erosion composition of the present invention is to prevent tracking and inhibit erosion, the material is also effective in stabilizing the insulation under arcing conditions, i.e., in cases where a direct arc passes between two parts of an electrical apparatus forming a carbonaceous track along its line. This phenomenon is similar to, but distinguishable from, tracking where, for example, conductive contaminant and/or surface irregularities cause a leakage current and a dendritic carbonaceous path develops on the surface of the insulation.

The insulating material and compositions of the present invention may, if desired, contain other fillers; for example, flame retardants, reinforcing fillers, pigments and mixtures thereof.

The anti-tracking and erosion composition can be incorporated into polymer(s) by any of the commonly used techniques; for example, in a two-roll mill at elevated temperatures. Similarly, the resulting compositions can readily be processed into sheets of material or other molded, or otherwise shaped, articles by any of the usual methods, such as extrusion, injection molding and the like.

The following examples illustrate the invention, parts being by weight unless otherwise stated. The surface area of the alumina trihydrate used in these examples is 12–15m$^2$/g.

In Table I is shown results obtained by the addition of varying amounts of nickel bis [O-ethyl (3,5-di-t-butyl-4-hydroxybenzyl) phosphonate[ to an insulating material employing alumina hydrate as an anti-tracking agent in its effect on retarding failure by erosion. The results were obtained by following the A.S.T.M. D2303, "Liquid Contaminant inclined plane Tracking and Erosion of Insulating Materials", test method using a constant voltage of 3.0 KV.

TABLE I

| Components | Composition of the Insulating Material(by Parts)[2] Test I | II | III | IV | V | VI |
|---|---|---|---|---|---|---|
| EPDM rubber[1] | 100 | 100 | 100 | 100 | 100 | 100 |
| Low density polyethylene | 100 | 100 | 100 | 100 | 100 | 100 |
| alumina trihydrate | 75 | 75 | 75 | 75 | 75 | 75 |
| Antioxidant[4] | 4 | 4 | 4 | 4 | 4 | 4 |
| erosion inhibitor | 0 | 0.25 | 0.50 | 1.0 | 2.0 | 4.0 |
| crosslinking aid[5] | 1 | 1 | 1 | 1 | 1 | 1 |
| peroxide[6] | 5 | 5 | 5 | 5 | 5 | 5 |
| Failure Mode | Erosion | Erosion | Erosion | Erosion | Erosion | Erosion |
| Time to Failure (min.) | 83* | 87* | 119* | >300 | >300 | >300 |
| Weight Loss (g/min.)[3] | 0.040* | 0.050* | 0.0415* | 0.0011 | 0.0010 | 0.0007 |

(*Average values for specimens which failed only by erosion.)
[1]A diene modified ethylene-propylene rubber
[2]The samples were press cured at 375° F (190° C) for 10 minutes.
[3]Samples weighed 40 gms.
[4]Tetrakis [methylene 3-(3',5'-di-t-butyl-4'-hydroxyphenyl) propionate] methane (Irganox 1010 from CIBA-Giegy)
[5]Triallylcyanurate
[6]2,5 - dimethyl -2,5-di(t-butylperoxy) hexyne-3 (Luperco 130XL from Pennwalt Chemicals).

In Table II are shown the results of the addition of various erosion inhibiting compounds to an insulating material and their effect on retarding failure by erosion. The results were obtained following ASTM D2303 test method at a constant voltage of 3.0 KV. The insulating material comprised the following:

| Components | Parts |
|---|---|
| EPDM rubber | 100 |
| Low density polyethylene | 100 |
| alumina trihydrate | 75 |
| SAF carbon black (masterbatch of SAF in polyethylene containing 0.07 parts of pure carbon black) | 1.4 |
| antioxidant (Irganox 1010) | 4 |
| peroxide (Luperco 130 XL) | 5 |
| crosslinking aid (triallylcyanurate) | 1 |
| erosion inhibitor (See Table) | 4 |

TABLE 2

| Erosion Inhibitor | Failure Tradename/Sold By | Time to Mode | Failure (Min.) | Weight Loss (g/min.) |
|---|---|---|---|---|
| None | | Erosion | 83 | 0.043 |
| Nickel Phosphate | | Erosion | >300 | 0.0009 |
| Nickel bis [0-ethyl (3,5-di-t-butyl-4-hydroxybenzyl) phosphonate] | Irgastab 2002/ Ciba-Geigy | Erosion | >300 | 0.0007 |
| 0,0-di-n-octadecyl-(3,5-di-t-butyl-4-hydroxybenzyl) phosphonate | Irganox 1093 Ciba-Geigy | Erosion | >300 | 0.0008 |
| Diethyl benzyl phosphonate | Eastman Kodak | Erosion | >300 | 0.0008 |
| Diamyl amyl phosphonate | Weston DAAP/Weston Chemical | Erosion | >300 | 0.0014 |
| Diethyl ethyl Phosphonate | Eastman Kodak | Erosion (Flaming) | 123 | 0.037 |
| Cobalt (II) dicyclohexyl-dithio phosphinate | Cyasorb UV 2548/ American Cyanamid | Erosion | >300 | 0.0007 |
| Diethyl phenyl phosphonate | | Erosion | >300 | 0.0008 |
| Aluminim tri[O-ethyl benzyl | | Erosion | >300 | 0.0010 |

TABLE 2-continued

| Erosion Inhibitor | Failure Tradename/Sold By | Time to Mode | Failure (Min.) | Weight Loss (g/min.) |
|---|---|---|---|---|
| phosphonate] | | | | |
| phenyl phosphonic acid | | Erosion | >300 | 0.0004 |
| sodium benzene phosphinate | | Erosion | >300 | 0.0008 |
| Nickel Acetylacetonate | | Erosion | 86 | 0.056 |
| Nickel Naphthenate | | Erosion | 72 | 0.052 |
| Nickelocene | | Erosion | 76 | 0.067 |
| Tri (3-t-butyl-4-hydroxyphenyl) phosphate | | Erosion | 73 | 0.071 |
| Tribenzyl phosphate | | Erosion | 76 | 0.048 |
| Trilauryl Trithiophosphite | | Erosion | 100 | 0.046 |
| Triisooctyl phosphite | | Erosion | 82 | 0.057 |

The results clearly show that alumina trihydrate alone, or in combination with organo-nickel compounds, organic phosphates or organic phosphites are ineffective in substantially inhibiting failure of the insulating material by erosion. However, various phosphonate and phosphinate compounds in combination with alumina trihydrate are effective in substantially retarding erosion failure. It should be noted that the low time to failure value for the diethyl ethyl phosphonate was apparently due to its volatility.

It should also be noted that nickel phosphate in combination with alumina trihydrate is also effective in substantially retarding erosion failure.

While an embodiment and application of this invention has been shown and described, it will be apparent to those skilled in the art that many more modifications are possible without departing from the inventive concepts herein described. The invention, therefore, is not to be restricted except as is necessary by the prior art and by the spirit of the appended claims.

We claim:

1. A high-voltage electrically insulating material comprising at least one polymer and a composition comprising an additive effective in reducing tracking and a compound selected from the group consisting of nickel phosphate, a compound of Formula I, a compound of Formula II, a compound of Formula III and mixtures thereof;

Formula I

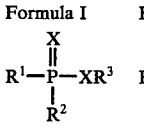

Formula II

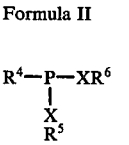

Formula III

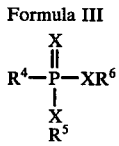

wherein each X is independently selected from oxygen or sulfur and wherein $R^1$ through $R^6$ can be the same or different and are independently selected from hydrogen or an organic group bound to P or X by carbon and wherein $R^3$, $R^5$ and $R^6$ can independently be a metallic or ammonium cation.

2. The material of claim 1 wherein the anti-tracking additive is a hydrate of alumina.

3. The material of claim 2 wherein the hydrate is alumina trihydrate.

4. The material of claim 1 wherein said compound comprises at least 0.1% by weight of the total weight of the electrically insulating material.

5. The material of claim 4 wherein the compound comprises up to about 5% by weight of the electrically insulating material.

6. The material of claim 5 wherein the compound comprises 0.35 to 1.5% by weight of the electrically insulating material.

7. The material of claim 1 wherein the composition comprises at least about 15% by weight of the electrically insulating material.

8. The material of claim 7 wherein the composition comprises up to about 75% by weight of the electrically insulating material.

9. The material of claim 8 wherein the composition comprises 20–45% by weight of the weight of the electrically insulating material.

10. The material of claim 1 wherein the compound is nickel phosphate.

11. The material of claim 1 wherein the compound is the compound of Formula I.

12. The material of claim 11 wherein X is oxygen.

13. The material of claim 12 wherein the compound of Formula I is sodium benzene phosphinate.

14. The material of claim 11 wherein x is sulfur.

15. The material of claim 14 wherein the compound of Formula I is cobalt (II) dicyclohexyldithiophosphinate.

16. The material of claim 1 wherein the compound is the compound of Formula III.

17. The material of claim 16 wherein X is oxygen.

18. The material of claim 17 wherein the compound is nickel bis[O-ethyl (3,5-di-t-butyl-4-hydroxybenzyl) phosphonate].

19. The material of claim 17 wherein the compound is O,O-di-n-octadecyl-(3,5-di-t-butyl-4-hydroxybenzyl)-phosphonate.

20. The material of claim 17 wherein the compound is diethyl benzyl phosphonate.

21. The material of claim 17 wherein the compound is diamyl amyl phosphonate.

22. The material of claim 17 wherein the compound is diethyl ethyl phosphonate.

23. The material of claim 17 wherein the compound is diethyl phenyl phosphonate.

24. The material of claim 17 wherein the compound is aluminum tri[O-ethyl benzyl phosphonate].

25. The material of claim 17 wherein the compound is phenyl phosphonic acid.

26. The material of claim 16 wherein x is sulfur.

27. The material of claim 1 wherein the compound is the compound of Formula II.

28. The material of claim 27 wherein X is oxygen.

29. The material of claim 27 wherein X is sulfur.

30. A high-voltage electrically insulating material comprising a heat recoverable polymeric material and a composition comprising an additive effective in reducing tracking and a compound selected from the group consisting of nickel phosphate, a compound of Formula I, a compound of Formula II, a compound of Formula III and mixtures thereof;

Formula I

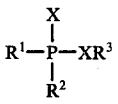

Formula II

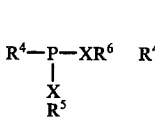

Formula III

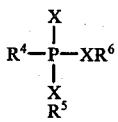

wherein each X is independently selected from oxygen or sulfur and wherein $R^1$ through $R^6$ can be the same or different and are independently selected from hydrogen or an organic group bound to P or X by carbon and wherein $R^3$, $R^5$ and $R^6$ can independently be a metallic or ammonium cation.

31. The material of claim 30, wherein the hydrate is alumina trihydrate.

32. The material of claim 30, wherein the compound comprises 0.35 to 1.5% by weight of the electrically insulating material.

33. The material of claim 30, wherein the composition comprises at least about 15% by weight of the electrically insulating material.

34. The material of claim 30, wherein the compound is the compound of Formula I.

35. The material of claim 30, wherein the compound is the compound of Formula III.

36. The material of claim 30, wherein the compound is the compound of Formula II.

* * * * *